United States Patent [19]

Perovick et al.

[11] Patent Number: 4,630,599

[45] Date of Patent: Dec. 23, 1986

[54] HYDROMASSAGE APPARATUS

[75] Inventors: Matthew J. Perovick, Cleve; James W. Lang, Lakewood, both of Ohio

[73] Assignee: Unidyne, Inc., Cleveland, Ohio

[21] Appl. No.: 824,540

[22] Filed: Jan. 31, 1986

[51] Int. Cl.[4] ..... A61H 9/00; A47K 3/10

[52] U.S. Cl. ..... 128/66; 4/544; 4/568; 128/33

[58] Field of Search ..... 128/38–40, 128/24 A, 33, 66; 4/541–544, 552, 567–570

[56] References Cited

U.S. PATENT DOCUMENTS

| | | | |
|---|---|---|---|
| D. 203,311 | 12/1965 | McNair | D83/1 |
| 3,065,746 | 11/1962 | Gregory | 128/66 |
| 3,288,134 | 11/1966 | Reich | 128/66 |
| 3,304,936 | 2/1967 | Kosta | 128/66 |
| 3,319,266 | 5/1967 | Schneider et al. | 4/180 |
| 3,391,411 | 7/1968 | Miller | 4/178 |
| 3,452,370 | 7/1969 | Jacuzzi | 4/180 |
| 3,580,247 | 5/1971 | Schneider | 128/66 |
| 3,591,872 | 7/1971 | Vanegas et al. | 4/178 |
| 3,614,952 | 10/1971 | Agnellino | 128/66 |
| 3,805,772 | 4/1974 | Mickelson | 128/66 |
| 3,806,964 | 4/1974 | Vanegas et al. | 4/180 |
| 3,820,173 | 6/1974 | Weller | 4/172.17 |
| 3,911,505 | 10/1975 | Zaborowsky | 4/544 |
| 3,977,027 | 8/1976 | Speck | 128/66 |
| 4,127,117 | 11/1978 | Peterson, Jr. | 128/66 |
| 4,402,094 | 9/1983 | Sanders | 4/541 |
| 4,577,624 | 3/1986 | Patton | 128/40 |

FOREIGN PATENT DOCUMENTS

| | | | |
|---|---|---|---|
| 348298 | 2/1922 | Fed. Rep. of Germany | 128/66 |
| 1802311 | 5/1970 | Fed. Rep. of Germany | 4/544 |

*Primary Examiner*—Clyde I. Coughenour
*Attorney, Agent, or Firm*—Robert R. Hussey

[57] ABSTRACT

A hydromassage apparatus produces a whirlpool action in a conventional bathtub having a water inlet, conduit and drain valve control in the end of the bathtub. The hydromassage assembly is adapted to be partially immersed in the bathtub filled with a supply of water and includes a housing having a pair of leg portions positioned adjacent opposing sides of the drain valve control and down the ends of the bathtub. The leg portions have lower portions which are adapted to be immersed in the bathtub when filled with a liquid. The housing also includes an intermediate portion innerconnecting the leg portions. The housing has an inlet chamber and an outlet chamber extending between the lower immersed portions of the legs. The inlet chamber has at least one inlet opening in each of the legs for receiving liquid contained in the bathtub into the inlet chamber. The outlet chamber has at least one opening in the lower portions of the legs for allowing pressurized liquid to flow therefrom and provide a hydromassage whirlpool action. The housing includes a front and a rear member, one of which members has a partition portion extending between the lower portions of the leg portions. The other member has a grooved portion formed complimentary to the partition portion for receiving the partition portion therein to separate the inlet and outlet chambers. The intermediate portion of the housing has a front face contoured to allow water to flow from the water inlet conduit into the bathtub. The intermediate portion of the housing also has a side face contoured to the shape of the drain valve control to allow mounting of the housing adjacent to the drain valve control without impeding operation. The hydromassage apparatus also includes means for connecting the inlet chamber to a pump for receiving liquid from the inlet chamber and means for connecting the pump to the outlet chamber of the housing for providing a flow of pressurized liquid from the pump to the outlet chamber.

14 Claims, 7 Drawing Figures

HYDROMASSAGE APPARATUS

BACKGROUND OF THE INVENTION

This invention relates generally to a hydromassage apparatus and more particularly to a hydromassage apparatus that produces a whirlpool action in a conventional bathtub.

It is known that a whirpool bath may be employed for medical or other purposes such as for therepeutic massage in the treatment or relief of sore muscles, rheumatic or arthritic conditions and other medical or health improving effects. When the use of a whirlpool bath is desirable, it is convenient for the whirlpool bath to be located in the home and the cost of installing the whirlpool bath is minimized. Since most homes have a conventional bathtub already installed, it is particularly desirable to utilize a conventional bathtub for a whirlpool bath.

A variety of complicated structures have heretofore been disclosed for converting a conventional residential bathtub into a whirlpool bath by providing an apparatus for circulating water in the bathtub to create the desired whirlpool action. While these known apparatuses may be effective for their intended purpose, namely creating whirlpool action in a conventional bathtub, they have inherent shortcomings.

In a commmonly used hydromassage apparatus, a motor driven pump is located within or adjacent the bathtub and the outlet of the pump is connected to a discharge nozzle assembly beneath the water level in the bathtub. Water is ejected under high pressure from the nozzle by the pump and is directed toward the portion of the person's body undergoing treatment.

In one known hydromassage unit, the entire unit, including the motor and pump is located in a tank or bathtub or in contact with the water. With units of this type, the electric connections to the motor have to be positively insulated to prevent shorting. In some cases, people are reluctant to use a unit of this type knowing the inherent danger involved in operating an electrical device in water.

In another known type of hydromassage unit, the motor and pump are located outside of the tank while the nozzle assembly is located within the tank and is connected to the pump by hoses. A unit of this type, when used in a conventional bathtub requires assembly and disassembly at the respective start and completion of each period of use. Furthermore, the entire unit including the long hoses must be handled and stored during periods of non-use.

Other known hydromassage units are adapted to be positioned over the side of the bathtub with an electric motor positioned outside of the bathtub which motor is mechanically connected to a pump positioned inside the bathtub and below the level of water in the bathtub. One such known device is disclosed in U.S. Pat. No. 4,127,117. Such a known device requires the assembly and disassembly of the hydromassage unit and conventional bathtub at the respective start and completion of each period of use. Furthermore, such an entire unit must be handled in storage during periods of non-use. In addition, people are reluctant to use a unit of this type knowing the inherent danger involved in operating an electrical device in close proximity with water.

Other known hydromassage devices require making permanent changes and additions in the physical structure of the bathtub so that the bathtub would be provided with permanent, irremovable barriers and hazards which confine the user and usable space in the bathtub and which the user has to avoid for normal bathing purposes.

Yet other known hydromassage devices require the installation of various portions of the device, such as inlet and outlet ports, in the sides of the conventional bathtub. The installation of such an apparatus is extremely difficult due to the confined spaces in which conventional bathtubs are positioned. Furthermore, if an error is made in such an installation, the sides of the bathtub may be damaged and require the replacement of the entire bathtub. In addition, by locating the inlet and outlet ports below the normal level of water in a conventional bathtub, leaks may develop which create a nuisance and may even damage the area surrounding the bathtub and also damage to other articles in the home. Exemplary of such a known device is the therapeutic bathtub disclosed in U.S. Pat. Nos. 3,580,247 and 3,614,952.

Other known hydromassage devices provide the use of a nozzle inserted into the drain of a conventional bathtub. Such known devices are disclosed in U.S. Pat. Nos. 3,319,266; 3,452,370, and 3,591,872. These known devices require modifications to the existing plumbing associated with the conventional bathtub and require some assembly and disassembly of the device into and out of the drain to allow full use of the bathtub when the known device is not in use.

Another known hydrotherapy installation provides for modifying the plumbing of a conventional bathtub drain so water may be drawn from the bathtub through the drain. After the water is pressurized it is returned to the bathtub under pressure through a conduit over the end of the bathtub. Such installations are disclosed in U.S. Pat. Nos. 3,806,964 and 3,288,134.

Accordingly, it is desirable that a hydromassage apparatus be used in connection with a conventional bathtub which is already in place and installed. This minimizes the installation cost and eliminates the need to allocate other living space for the hydromassage apparatus. It is also desirable that a hydromassage unit be used in a conventional bathtub without taking up any space in the bathtub that may be used when the hydromassage unit is not in use.

A further desirable feature of a hydromassage unit allows the use of the bathtub, water inlet, drain control, and drain while the hydromassage unit is in place. It is also desirable to provide a hydromassage unit that does not require modifications to the existing plumbing of the bathtub.

It is advantageous to provide a hydromassage apparatus which does not require any modifications to the bathtub which may create undesirable leakage of water from the bathtub and also the attendant installation difficulties of such modifications. It is further desirable to provide a hydromassage unit which does not require any assembly or disassembly of the unit when it is to be used. Such a unit also avoids the attendant storage problems of the disassembled parts of the hydromassage unit.

It is also desirable to provide a means for electrically isolating and protecting the water in the bathtub from electrical charge. It is further desirable to provide a hydromassage unit which may be produced and installed at a minimum of cost and installation labor.

SUMMARY OF THE PRESENT INVENTION

The present invention provides the above described desirable features with an improved hydromassage apparatus for producing whirlpool action in a conventional bathtub. As is known, a conventional bathtub has a water inlet conduit or water faucet and a drain valve control in one end sidewall of the bathtub.

The hydromassage apparatus of the present invention provides a housing positioned adjacent the faucet and drain valve control on one end of the bathtub. By so positioning the housing, no usable space in the bathtub is taken up by the housing since the water faucet and drain valve control is also positioned adjacent the housing. This end of the bathtub is not generally used due to the space taken up by the water faucet and drain valve control.

The housing is partially immersed in water in the bathtub to allow the water to be received through inlets in the housing. The water is then conducted from the housing to a pump which pressurizes the water whereupon the water is conducted to an outlet in the housing. The pressurized water flows out of the outlet and into the bathtub to provide a hydromassage whirlpool action.

The present invention also provides a hydromassage apparatus which does not require any modification to existing plumbing associated with the bathtub. The housing of the present invention is positioned on the end of the bathtub in which the water faucet and drain control are positioned. Generally, this end of the bathtub is positioned against a wall with an access door on the other side of the wall to allow for servicing the existing plumbing. A portion of the housing extends above the bathtub and adjacent the wall. Hydraulic connections to the housing are provided through this wall with associated conduits or tubes. The tubes hydraulically connect the inlet and outlet of the housing to the pump unit. The pump may be positioned at a remote location or even in the wall. By providing the hydraulic connections above the bathtub, no modifications need be made to the bathtub, openings through the bathtub which may allow leakage are avoided, and simplified installation of the housing is accomplished.

The housing of the hydromassage apparatus of the present invention has a pair of leg portions positioned adjacent the opposing sides of the drain valve control and extend downwardly into and are immersed in the water in the bathtub. The inlet and outlet are positioned in the lower portions of the legs and are immersed in water. Accordingly, the advantageous feature of not requiring any modification to the bathtub with the installation of an inlet or outlet through a side of the bathtub is achieved.

To further achieve the desirable features of the hydromassage apparatus of the present invention, the housing of the apparatus of the present invention has a front and rear member, one of which members has an internal partition portion extending between the legs of the housing. The other member has a groove portion formed complimentary with the partition portion. The groove portion receives the partition portion therein to form an inlet and an outlet chamber inside the housing. Accordingly, an inlet chamber and an outlet chamber extending between the legs of the housing are provided. Each of the legs has inlet openings which provide for drawing water from the bathtub and an outlet opening which provides for returning that water to the bathtub under pressure. A gasket is provided between the housing and the bathtub to avoid damage to the bathtub and minimize any vibration when the hydromassage apparatus is in operation. Such a housing is of simplified construction and minimizes manufacturing and installation costs.

DETAILED DESCRIPTION OF THE INVENTION

Figure 2:
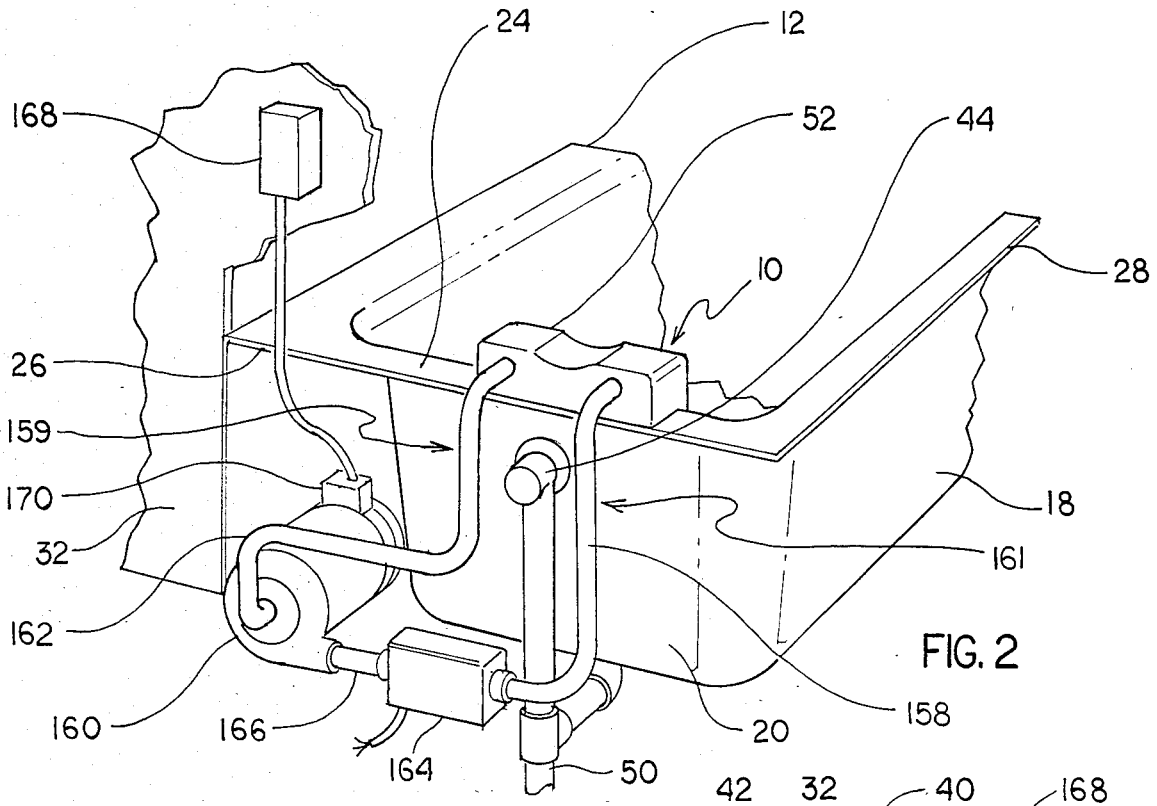
FIG. 2 is a perspective view of the hydromassage apparatus of the present invention mounted in a conventional bathtub and taken from the outside of the bathtub.
Figure 1:
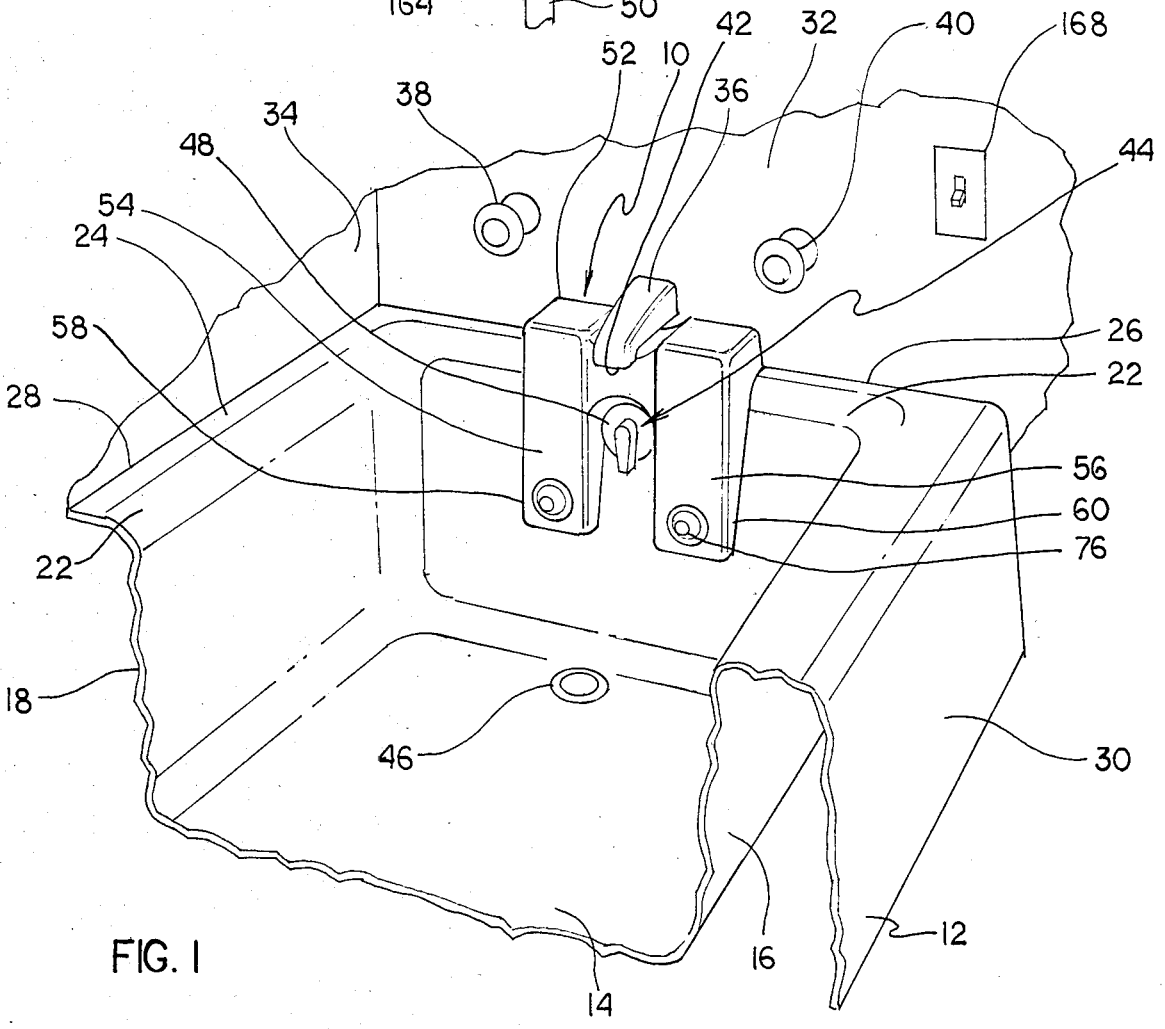
FIG. 1 is a perspective view of the hydromassage apparatus of the present invention having a housing mounted in a conventional bathtub taken from the inside of the bathtub.

Referring now more specifically to the drawings and more particularly to FIGS. 1 and 2, a hydromassage apparatus 10 embodying the features of the present invention is shown for creating a whirlpool action in a conventional bathtub 12. While but one bathtub design is disclosed in the drawings, it should be understood that it is within the contemplation of this invention to provide a hydromassage apparatus 10 that may be used with bathtubs of a wide variety of constructions and designs.

The conventional bathtub 12 has a bottom 14 with an outer side 16, an inner side 18, an end side 20, and an opposing end side (not shown) extending upwardly of the bottom to form a bathtub for holding water therein. The sides 16, 18, and 20 terminate in a flared portion 22 which is curved outwardly from the sides 16, 18, and 20. The outwardly flared portion 22 terminates in an upper sill 24 which extends around the top of the sides 16, 18, and end 20 of the bathtub 12 and outwardly therefrom in a generally horizontal direction. The upper sill 24 terminates in an outer edge 26 adjacent the end 20, an outer edge 28 adjacent the inner side 18, and an outer panel 30 adjacent the outer side 16. The outer panel 30 provides a finished appearance in the bathroom when the bathtub is installed.

While there are many techniques and designs for installing a bathtub and particularly the bathtub 12, one generally used installation provides for positioning the outer edges 26, 28 of the end 20 and inner side 20, 18 against the walls 32 and 34, respectively, forming a corner. The walls 32, 34 extend upwardly of the respective edges 26, 28 of the bathtub 12.

In order to fill the bathtub 12 with water, any conventional means may be used. Typically, a water inlet conduit or faucet 36 extends from the wall 32 to a position above the bottom 14 of the bathtub 12. The faucet 36 is spaced a distance vertically above the upper sill 24 of the bathtub 12. Hot and cold water control valves 38, 40 respectively, are positioned on the wall 32 and control the amount of hot and cold water flowing through the faucet 36 and into the bathtub 12 through the discharge opening 42 in the faucet 36. The plumbing connections for interconnecting the source of hot and cold water with the valves 38, 40 respectively, and conducting that water to the faucet 36 are well known and may be of any known construction. In addition, the water control valves may be of any known construction.

When water flows through the discharge opening 42 of the faucet 36, it falls in a vertical direction adjacent the end 20 of the bathtub 12. So as to minimize the amount of space taken up in the bathtub 12 by the faucet 36, the discharge opening 42 of the faucet is relatively close to the end 20 of the bathtub.

To control the level of water in the bathtub 12 any conventional means may be used such as the means 44 which include a drain valve 46 and a drain valve control 48 as seen in FIGS. 1 and 2. The drain valve 46, when in an open or raised position, allows water to flow out of the bathtub 12 through the drain conduit 50. When the drain valve 46 is in a closed or lowered position, the water in the bathtub 12 is blocked from flowing from the bathtub through the drain conduit 50. The bathtub 12 may then be filled to a normal bathing level through the faucet 36.

The drain valve 48 is operable to move the drain valve 46 between the open and closed positions and is generally positioned on the end 20 of the bathtub 12 and in vertical alignment with the faucet 36. The drain valve control 48 also includes an overflow drain incorporated therein. The overflow drain allows the water to flow from the bathtub 12 into the drain conduit 50 when the water reaches the level of the drain valve control as is known.

As can be seen from the above, by mounting the faucet 36 and the drain valve control 48 on the end 20 of the conventional bathtub 12, some amount of space is taken up in the bathtub and that space is rendered unusable. This condition generally exists in many conventionally installed bathtubs prior to installation of the present invention. The hydromassage apparatus 10 of the present invention is mounted in this unusable space and allows for normal operation of the existing faucet 36 and the drain valve control 48.

Figure 3:
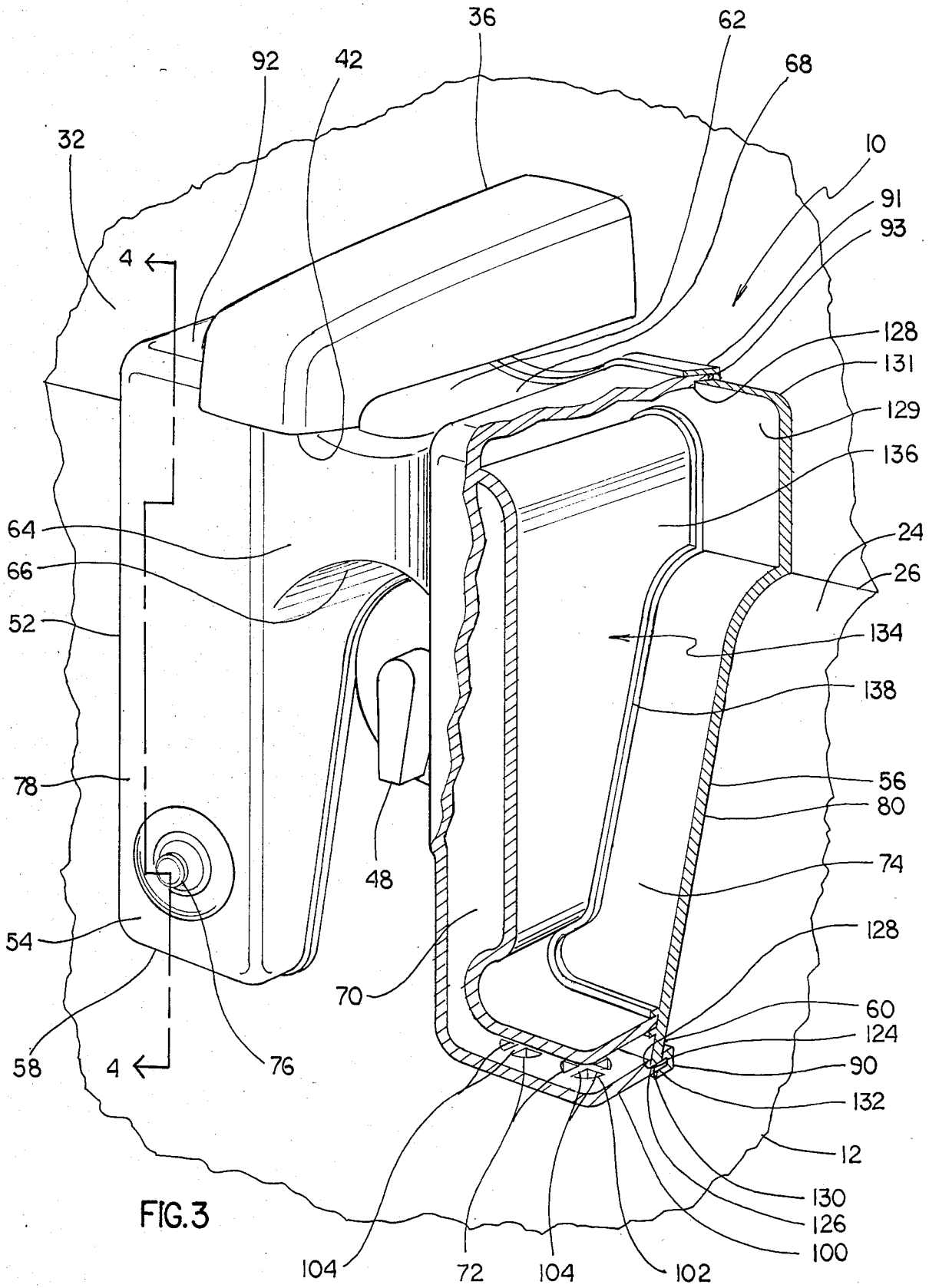
FIG. 3 is an enlarged partial, cross-sectional perspective view of the housing of the present invention mounted in a conventional bathtub as shown in FIG. 1.

The hydromassage apparatus 10 includes a housing 52 mounted on the end 20 of the bathtub 12 adjacent the faucet 42 and drain valve control 48 as seen in FIGS. 1, 2, and 3. The housing 52 has a pair of leg portions 54, 56 positioned adjacent opposing sides of the drain valve control 48. The leg portions 54, 56 have lower portions 58, 60 which are immersed in the water in the bathtub 12 when the water is at the normal bathing level. The housing 52 has an intermediate portion 62 innerconnecting and extending between the upper portion of the leg portions 54, 56 of the housing 52.

The intermediate portion 62 is formed so as to allow the the housing 52 to be positioned adjacent the faucet 36 and the drain valve control 48 as hereinabove described, without limiting the operation of either the faucet or the drain valve control or the overflow feature of the drain valve control. As can be seen in FIG. 3, the intermediate portion 62 has a front face 64 which is contoured to allow water to flow from the existing faucet 36 without interferring with the flow of water. The front face 64 has an inwardly curved shape extending from the legs 54, 56 of the housing 52 and inwardly toward the end 20 of the bathtub 12. This curved configuration allows for the free flow of water from the discharge opening 42 in the faucet 36 without any modification of the faucet or plumbing.

The bottom side portion 66 of the intermediate portion 62 is contoured to allow mounting the housing 52 adjacent the drain valve control 48 without impeding its operation. The bottom side portion 66 has an inwardly curved shape extending between the legs 54, 56 and away from the drain valve control 48. This curved configuration allows for operation of the drain valve control 48 without interference or removing the housing 52. Further, the lower portion of the drain valve control 48 is left exposed so as to allow for the operation of the drain valve control overflow feature.

The intermediate portion 62 of the housing 52 also has a top side portion 68 which is contoured so as to accommodate various positions of the faucet 36 and allow for easy positioning of the housing 52 between the faucet and the drain valve control 48. The top side portion 68 is generally curved inwardly so as to decrease the space between the bottom and top opposing surfaces 66, 68 of the intermediate portion 62 of the housing 52. The inwardly curved top surface 68 allows for accommodating various designs and positions of the faucet 36 and allows for ready positioning of the housing 52 upon installation.

To produce the whirlpool action in a conventional bathtub, the hydromassage apparatus 10 of the present invention provides for drawing water from the bathtub, pressurizing the bath water and returning the pressurized water to the bathtub in continuous whirlpool movement. The housing 52 has an inlet chamber 70 as seen in FIG. 3 into which water is drawn from the bathtub 12 through the inlet opening 72. The water is then drawn from the inlet chamber 70 and pressurized, as will be hereinafter described. The pressurized water is then returned under pressure to the outlet chamber 74 of the housing 52 and subsequently flows therefrom through the outlet openings 76 into the bathtub 12 to hereby provide a therapeutic whirlpool action in the bathtub.

Figure 4:
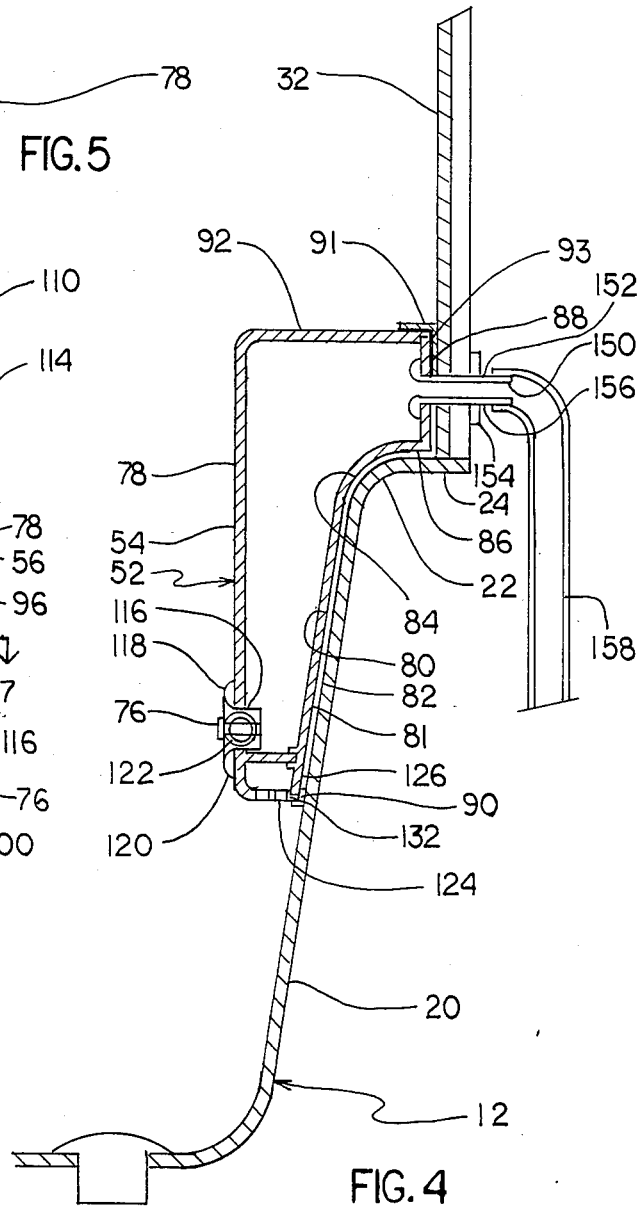
FIG. 4 is a cross-sectional view of the apparatus of the present invention and taken along line 4—4 of FIG. 3.

The housing 52 includes a front member 78 and a rear member 80 which, when assembled, form the inlet chamber 70 and outlet chamber 74. As seen in FIG. 4, the rear member 80 of the housing 52 has a rear surface 81 formed complimentary to the bathtub 12, flared portion 22 and upper sill 24 of the bathtub and the wall 32 so that the housing may be conveniently located on the end side 20 of the bathtub as described herein. The rear surface 81 of the rear member 80, has a bathtub side surface portion 82 formed complimentary with the end 20 of the bathtub 12, a flared surface portion 84 formed complimentary with the flared portion 22 of the bathtub, a sill surface portion 86 formed complimentary with the sill 24 of the bathtub, and a wall surface portion 88 formed complimentary with the wall 32. Accordingly, when the housing 52 is mounted to the wall 32 and adjacent the bathtub 12, the rear surface 81 is shaped complimentary with the bathtub and wall and spaced therefrom by means of a gasket 90 and molding 91 with shim 93 as will be hereinafter more fully described.

As seen in FIGS. 3, 4, 5 and 6, the front member 78 of the housing 52 is formed complementary with the rear member 80 to form the inlet and outlet chambers 70, 74. The front member 78 includes a top portion 92 defining the top of the legs 54, 56 and the top side face 68 of the intermediate portion 62. The front member 78 has outer side portions 94, 96 extending downwardly of the top portion 92 and forming the outer sides of the legs 54, 56 respectively. At this point it should be understood legs 54, 56 extend downwardly a sufficient distance so that when water in the bathtub 12 is at the normal bathing level, the lower portions 58, 60 of the legs 54, 56 respectively are submerged in the water.

The outer side portions 94, 96 of the front member 78 terminate in the bottom portions 98, 100 respectively. Since the bottom portions 98, 100 define the deepest point of submersion of the housing 52 in the water in the bathtub 12, the inlet openings 72 are provided in the bottom portions 98, 100.

Each of the inlet openings 72 have means 102 for restricting the entry of foreign objects into the inlet chamber 70 as seen in FIG. 3. The strainer portions 104 extend across the inlet openings 72 and restrict entry of foreign particles therethrough. It should be understood it is within the contemplation of this invention to provide other means for restricting the entry of foreign particles dependent, of course, on the use of the apparatus 10 and the nature of foreign objects in the water. One such other means would include mesh screening in cases where finer particles were in the water. By removing such objects, the operation of the apparatus 10 is improved by minimizing the restriction of water flow through the apparatus 10 caused by foreign objects.

Figure 5:
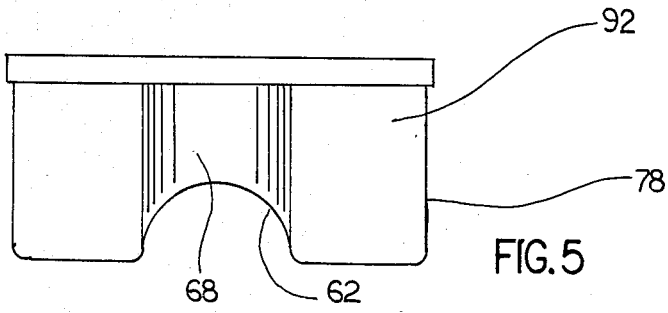
FIG. 5 is a top view of the housing of the present invention.
Figure 6:
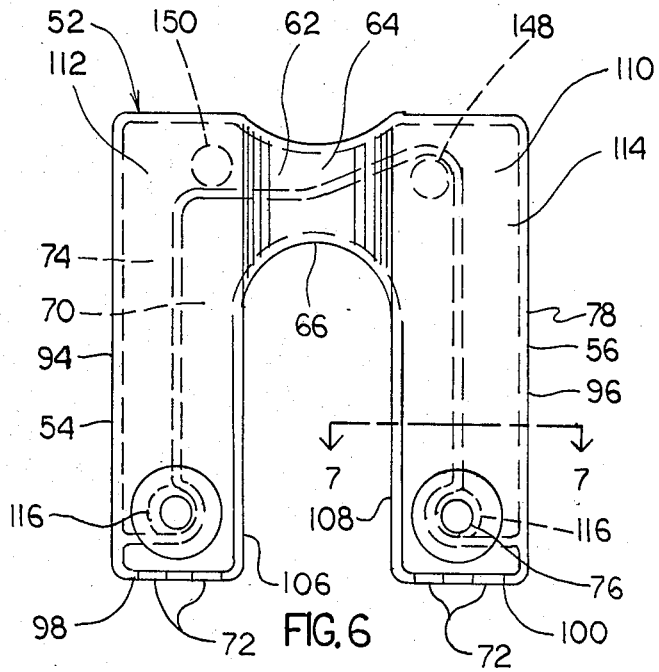
FIG. 6 is a side elevational view of the housing of the present invention.
Figure 7:
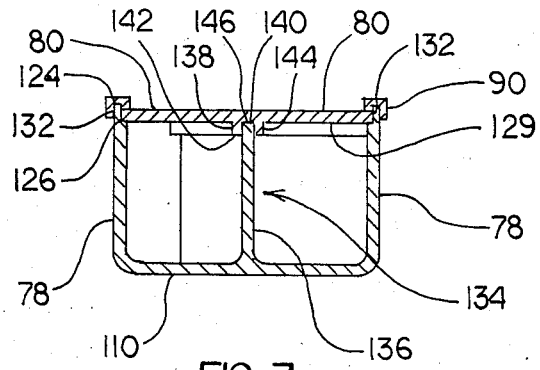
FIG. 7 is a cross-sectional view of the housing shown in FIG. 6 and taken along line 7—7 thereof.

As seen in FIG. 6, the front member 78 of the housing 52 includes inner side portions 106, 108 extending from bottom portions 98, 100 respectively in a direction toward the intermediate portion 62 of the housing. The inner side portions 106, 108 terminate at the bottom side portion 66 of the intermediate portion 62 as hereinabove described. Accordingly, as seen in FIGS. 3, 5, and 6, the sides of the front member 78 are defined by the top portion 92, outer side portions 94, 96, bottom portions 98, 100, inner side portions 106, 108 and the bottom side face 60. In FIG. 6, the front face 110 of the front member 78 include front leg portions 112, 114 and the front face 64 of the intermediate portion 62 therebetween. The outlet openings 76 are provided in each of the front leg portions 112, 114 of the front face 110 and are adjacent, yet spaced from the inlet openings 72. The outlet openings 76 are submerged in the water in the bathtub 12 when the water is at the normal bathing level.

For ease of description, one outlet opening 76 will be described herein. It should be understood that the outlet opening 76 in each of the legs 54, 56 are constructed in a similiar manner. As seen in FIG. 4, the outlet fixture opening 116 is provided in the leg 54 of the housing 52 and receives an outlet fixture 118 therein.

The fixture 118 provides an outlet fixture housing 120 secured in the opening 116 of the housing 52 and sealed to the housing 52. The outlet fixture 118 also includes an outlet fixture nozzle 122 rotatably mounted in the housing 120. The outlet opening 76 extends through the outlet fixture nozzle 122. By movement of the outlet fixture nozzle 122 with respect to the housing 120, the direction of the water flowing through the outlet opening 76 may be set in a variety of directions. Accordingly, the therapeutic whirlpool action may be set in the desired direction. It should be understood that the outlet fixture 118 may be of any known design.

As seen in FIGS. 3, 4, 6, and 7 the front and rear members 78, 80 are designed to be assembled to form the housing 52. This is accomplished by a complimentary edge design which allows for ready assembly and joinder of the front and rear members 78, 80 respectively. The top portion 92, outer side portions 94, 96, bottom portions 98, 100, inner side portions 106, 108 and bottom side face 66 of the front member 78 terminate in a contiguous outer edge 124. The portions, 82, 84, 86 and 88 of the rear member 80 terminate in a contiguous outer edge 126 which is complimentary with the edge 124 in a manner which allows assembly thereof.

To allow for such assembly of the front and rear members 78, 80, the outer edge 124 of front member 78 has an inner edge 128 against which the inner surface 129 of the rear member 80 abuts when assembled. The outer edge 124 of the front member 78 includes a lip 130 extending outwardly of the inner edge 128 a distance greater than the thickness of the rear member 80. In the region of the wall surface portion 88 of the rear member 80, the lip 130 does not extend outward of the rear surface 81 of the rear member 80. The outer edge 126 of the rear member 80 terminates in a peripheral edge 131 which is adjacent to the outwardly extending lip 130 when the front and rear members 78, 80 are in an assembled relationship. The front and rear members 78, 80 may then be sealed together with any conventional sealant such as epoxy glue. Other known means for assembling the front and rear members 78, 80 may also be used.

It should be understood that the outer edge 124 of the front member 78 has a geometric configuration similiar to the rear surface 81 of the rear member 80. When assembled, the outer edge 124 has a shape complimentary to the bathtub 12 and wall 32 as hereinabove described in connection with the rear surface 81. When in operation, pulsing and vibration of the housing 52 may occur, and accordingly, a U-shaped gasket 90 is mounted on and secured to the lip extension 132 of the outer edge 124 of the front member 78. The gasket 90 extends around the lip extension 132. The gasket 90 dampens any vibration that may occur and also avoids damage to the end 20 of the bathtub 12 on which the housing 52 is mounted.

The gasket 90 terminates adjacent the wall surface portion 88 of the rear member 80. The molding member 91 is positioned between the wall surface portion 88 and the wall 32. To accommodate installations of a variety of bathtub and wall constructions, the shim member 93 may also be positioned between the wall 32 and the wall surface portion 88. It should be understood that dependent upon the bathtub and wall construction, additional shim members 93 may be used. On the other hand, no shim members 93 or molding members 91 may be necessary to provide for mounting the apparatus 10 to the wall 32 as herein described.

By positioning the molding member 91 and, if necessary, sufficient shim members between the housing 52 and the structural wall 32, the space between the housing and the structural wall is completely filled. Accordingly, when the housing 52 is secured to the wall 32, a solid connection is effectuated therebetween.

The housing 52 includes means 134 for providing the inlet and outlet chambers 74, 76 respectively. The means 134 includes a partition portion 136 in the front member 78 and a complimentary groove portion 138 in the rear member 80. One typical section showing the partition and groove portions 136, 138 respectively, is provided in FIG. 7. The partition portion 136 extends inwardly of the front face 110 of the front member 78 toward the rear member 80 where the front and rear are assembled and terminate in an edge 140.

The groove portion 138 of the rear member 80 includes a pair of opposed lips 142, 144 extending from the inner surface 129 of the rear member 80. The opposed lips 142, 144 define the groove 146 which receives the edge portion 140 of the partition portion 136 of the front member 78 therein. When assembled, an adhesive may be deposited in the groove 146 to effectively seal the edge portion 140 in the groove 146 and provide the inlet and outlet chambers 70, 74 respectively.

As seen in FIGS. 3, 5, and 6, the partition and groove portions 136, 138 are configured to define the inlet and outlet chambers 70, 74 respectively. The portions, 136, 138 extend inwardly from the outside portions 94, 96 of the front member 78, around the outlet fixture openings 116, and upwardly towards the top portion 92 of the front member.

As seen in FIGS. 4 and 6, the rear surface portion 88 of the rear member 80 has a discharge opening 148 for allowing water to flow from the inlet chamber 70, and a pressurized inlet opening 150 to allow pressurized water to flow into the outlet chamber 74. The openings 148, 150 are conveniently positioned above the bathtub 12 to allow installation and mounting of the housing 52 through the wall 32 without any modification to the bathtub or its associated plumbing. Also, by positioning the openings 148, 150 above the bathtub 12, leakage of water from the bathtub through the openings 148, 150 when the apparatus 10 is not in use is avoided. For ease of description, the pressurized inlet opening 150 will be hereinafter described, and it should understood that the discharge opening 148 is constructed in a similar manner.

As seen in FIG. 4, the pressurized inlet opening 150 is defined by a hydraulic fitting 152 which extends through the rear member 80, shim 93, molding member 91, and wall 32. A threaded fastner 154 is provided to secure the hydraulic fitting 152 and consequently the housing 52 to the wall 32 and bathtub 12 when in assembled position. The hydraulic fitting 152 is secured to the rear member 80 and extends therethrough. The hydraulic fitting 152 has a nipple 156 extending past the threaded fastner 154 to allow the conduit 158 to be attached thereto as will be hereinafter described.

As seen in FIGS. 3 and 6, the partition portion 136 and groove portion 138 are configured to hydraulically connect the inlet opening 72 to the discharge opening 148 through the inlet chamber 70 to allow water to flow from the bathtub 12 and to connect the pressurized inlet opening 150 to the outlet chamber 74 to allow pressurized water to flow from the outlet opening 76. By providing the complimentary partition and groove portions 136, 138, the inlet and outlet chambers 70, 74 are provided in a manner that allows for easy manufacture of the housing 52.

It should be understood that the hydraulic design of the housing 52 has the proper flow characteristics so as to allow sufficient water to flow into the inlet openings 72 and from the outlet chamber 74 through the outlet opening 76. The inlet openings 72 have a sufficient cross-sectional area to allow sufficient water to flow into the inlet chamber 70. The geometric configuration of the partition and groove portions 136, 138 allow for the flow of the water received in the inlet openings 72 to the discharge opening 148 in an efficient manner. The partition and groove portions 136, 138 are similiarly configured so as to allow an even flow of the pressurized liquid from the pressurized inlet opening 150 to the outlet openings 76.

The front and rear members 78, 80 are conveniently manufactured from a plastic material which allows for an inexpensive and convenient manufacture of the housing 52. It should be understood that it is within the contemplation of this invention to manufacture the housing 52 from a variety of materials and with a variety of designs while providing a housing with the advantageous features of the present invention.

A pump 160 is provided to draw water from the inlet chamber 70 and provide pressurized water to the outlet chamber 74 as seen in FIGS. 2, 4 and 6. Means 159 are provided for connecting the inlet chamber 70 to the pump 160. Means 161 are provided to connect the pump 160 to the outlet chamber 74 of the housing 52. The means 159 includes a hose 162 connected to the discharge opening 148 in a manner similiar that described in connection with the hose 158 and pressurized inlet opening 150. The hose 162 is connected to the inlet of the pump 160. The means 161 includes conduits 158, 160. The outlet of the pump 160 is connected to a heater 164 of the conduit 166. The outlet of the heater 164 is connected to the hose 158 so that heated pressurized water is supplied to the pressurized inlet opening 150 when the pump 160 and the heater are in operation. It should be understood that the heater 164 need not be included to provide the beneficial features of the present invention.

To activate the motor of the pump 160, a switch 168 is provided to allow operation of the pump from a remote location. The switch 168 may be of any conventional design and may include conventional pneumatic switches to avoid any potential electrical shock. A conventional wall switch with a ground relay 170 may also be used to avoid electrical shock.

Generally, an existing access door in the wall 32 is available to service the plumbing of the bathtub 12. The pump 160, heater 164 and conduits 162, 166 and 158 may be conveniently positioned in the wall 32 adjacent the access door to provide for ready installation of the hydromassage apparatus 10.

Having described my invention, I claim:

1. A hydromassage apparatus for producing whirlpool action in a conventional bathtub having a water inlet conduit and drain valve control in association with one wall of the bathtub, said hydromassage assembly adapted to be partially immersed in the bathtub filled with a supply of liquid, said hydromassage assembly comprising;

a housing having a pair of leg portions positionable adjacent opposing sides of the drain valve control and downward the one side of the bathtub, said leg portions having lower portions thereof adapted to be immersed in the bathtub when filled with a supply of liquid;

said housing having an intermediate portion interconnecting said leg portions;

said housing having an inlet chamber, said inlet chamber having at least one inlet opening in each of said lower immersed portions for receiving liquid contained in the bathtub into said inlet chamber, said inlet chamber extending between said inlet openings of said lower immersed portions of said leg portions;

said housing having an outlet chamber, said outlet chamber having at least one opening in each of said lower immersed portions of said leg portions for allowing pressurized liquid to flow therefrom and provide a hydromassage whirlpool action, said outlet chamber extending between said outlet openings of said lower immersed portions of said leg portions;

said intermediate portion of said housing having a front face contoured to allow water to flow from the water inlet conduit into the bathtub;

said intermediate portion of said housing having a side face contoured to allow mounting of the housing adjacent the drain valve control without impeding the operation thereof; and said hydromassage apparatus including means for connecting said inlet chamber to a pump for receiving liquid from said inlet chamber and means for connecting the pump to said outlet chamber of said housing for providing the flow of pressurized liquid from the pump to said outlet chamber.

2. A hydromassage apparatus as described in claim 1 in which said housing includes a front member and a rear member, one of said front and rear members having a partition portion extending between said lower immersed portions of said leg portions and the other of said front and rear members having a groove portion formed complimentary to said partition portion of said one member for receiving said partition portion therein.

3. A hydromassage apparatus as described in claim 1 in which said housing has a rear face contoured to the shape of the one wall of the bathtub.

4. A hydromassage apparatus as described in claim 3 which includes gasket means positioned between said housing and the one side of the bathtub for protecting the bathtub from damage thereto.

5. A hydromassage apparatus as described in claim 1 which includes means for restricting entry of foreign objects into said inlet chamber.

6. A hydromassage apparatus as described in claim 1 which includes molding and shim means for positioning between said housing and a structural wall.

7. A hydromassage apparatus for producing whirlpool action in a conventional bathtub having a water inlet conduit and drain valve control in association with one wall of the bathtub, said hydromassage assembly adapted to be partially immersed in the bathtub filled with a supply of liquid, said hydromassage assembly comprising;

a housing having a pair of leg portions positionable adjacent opposing sides of the drain valve control and downward the one side of the bathtub, said leg portions having lower portions thereof adapted to be partially immersed in the bathtub when filled with a supply of liquid;

said housing having an intermediate portion interconnecting said leg portions;

said housing having an inlet chamber, said inlet chamber having at least one inlet opening in each of said leg portions for receiving liquid contained in the bathtub into said inlet chamber said inlet chamber extending between said inlet openings of said lower immersed portions of said leg portions;

said housing having an outlet chamber, said outlet chamber having at least one opening in each of said lower immersed portions of said leg portions for allowing pressurized liquid to flow therefrom and provide a hydromassage whirlpool action, said outlet chamber extending between said outlet openings of said lower immersed portions of said leg portions;

said housing having a front member and a rear member, one of said members having a partition portion extending between said lower immersed portions of said leg portions and the other of said members having a grove portion formed complimentary to said partition portion of said one member for receiving said partition portion therein; and said hydromassage apparatus including means for connecting said inlet chamber to a pump for receiving liquid from the said inlet chamber and means for connecting the pump to said outlet chamber of said housing for providing the flow of pressurized liquid from the pump to said outlet chamber.

8. A hydromassage apparatus as described in claim 7 wherein said intermediate portion of said housing has a front face contoured to allow water to flow from the water inlet conduit into the bathtub.

9. A hydromassage apparatus as described in claim 7 wherein said intermediate portion of said housing has a side face contoured to allow mounting of the housing adjacent the drain valve control without impeding the operation thereof.

10. A hydromassage apparatus as described in claim 7 in which said housing includes a front member and a rear member, one of said front and rear members having a partition portion extending between said lower immersed portions of said leg portions and the other of said front and rear members having a groove portion formed complimentary to said partition portion of said one member for receiving said partition portion therein.

11. A hydromassage apparatus as described in claim 7 in which said housing has a rear face contoured to the shape of the one wall of the bathtub.

12. A hydromassage apparatus as described in claim 11 which includes gasket means positioned between said housing and the one side of the bathtub for protecting the bathtub from damage thereto.

13. A hydromassage apparatus as described in claim 7 which includes means for restricting entry of foreign objects into said inlet chamber.

14. A hydromassage apparatus as described in claim 7 which includes molding and shim means for positioning between said housing and a structural wall.

* * * * *